US006220239B1

(12) United States Patent
Kieslinger et al.

(10) Patent No.: US 6,220,239 B1
(45) Date of Patent: Apr. 24, 2001

(54) COOKING APPLIANCE DOOR WITH COOKING-PRODUCT SUPPORTS

(75) Inventors: Michael Kieslinger, Nussdorf; Klemens Roch, Trostberg, both of (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 0 days.

(21) Appl. No.: 09/505,378

(22) Filed: Feb. 16, 2000

(30) Foreign Application Priority Data

Feb. 16, 1999 (DE) ..... 199 06 362

(51) Int. Cl.[7] ..... F24C 15/16
(52) U.S. Cl. ..... 126/340; 126/190; 126/333
(58) Field of Search ..... 126/190, 200, 126/340, 339, 335, 19 R, 193, 21 R, 192

(56) References Cited

U.S. PATENT DOCUMENTS 2,049,237 7/1936 Wertzheiser .
2,782,292 * 2/1957 Long ..... 126/340
2,879,763 * 3/1959 Long ..... 126/340

FOREIGN PATENT DOCUMENTS 197 38 507 C1 11/1998 (DE) .
731692 * 6/1955 (GB) ..... 126/340

* cited by examiner

*Primary Examiner*—James C. Yeung
(74) *Attorney, Agent, or Firm*—Herbert L. Lerner; Laurence A. Greenberg; Werner H. Stemer

(57) ABSTRACT

A cooking appliance door has a door base. A front panel is secured at the front side and an inner panel is secured at the rear side of the door base. Cooking-product support brackets are fastened to the rear side of the cooking appliance door. In order to ensure a stable fastening of the cooking-product support brackets, they are fastened to the door base with fastening elements that extend through openings in the inner panel.

7 Claims, 2 Drawing Sheets

COOKING APPLIANCE DOOR WITH COOKING-PRODUCT SUPPORTS

BACKGROUND OF THE INVENTION

FIELD OF THE INVENTION

The present invention relates to a cooking appliance door with a door base, to which a front panel is secured at the front of the cooking appliance door; and an inner panel is secured at the rear of the cooking appliance door. Cooking-product support brackets are fastened at the rear of to the cooking appliance door. The invention also relates to a cooking appliance equipped with such a door.

Such a cooking appliance door is known from German Patent DE 197 38 507 C1. An oven-muffle door has an inner pane of glass or vitreous material, to which there is or are fastened one or more cooking-product support brackets for cooking-product supports, for example baking sheets or grilling grids.

SUMMARY OF THE INVENTION

It is accordingly an object of the invention to provide a cooking appliance door which overcomes the disadvantages of the heretofore-known cooking appliance doors of this general type and which ensures a stable fastening of cooking-product support brackets.

With the foregoing and other objects in view there is provided, in accordance with the invention, a cooking appliance door, including a door base having a front side and a rear side; a front panel secured at the front side of the door base; an inner panel secured at the rear side of the door base and having openings formed therein; at least one cooking-product support bracket fastened at the rear side of the door base; and fastening elements extending through the openings formed in the inner panel for fastening the at least one cooking-product support bracket to the door base.

In other words, the object of the invention is achieved by the cooking-product support brackets being fastened directly to the door base through the use of fastening elements extending through openings in the inner pane. The door base is in this case made from a more stable and mechanically more resistant material than that of the inner pane, in order to be able without any problem without any problem to absorb forces without any problems. Such forces may occur when the cooking-product supports are hung onto the door base or door frame and are loaded. Metals and adequately mechanically and thermally resistant plastics are known in particular as materials for the door base, while a material typically used for the inner pane is glass. A further advantage according to the invention is that the direct fastening of the cooking-product support brackets to the door base or door frame allows the geometrical coordination of the cooking-product support brackets to one another as well as in relation to the door base and to the further door components fastened thereto to be carried out more precisely than in the case of a corresponding fastening to the inner pane.

To further improve the stability of the fastening of the cooking-product support bracket, the door base has a reinforcing plate, to which the cooking-product support bracket is additionally fastened.

A flexible spacing element is advantageously respectively secured between the inner pane and the cooking-product support bracket on the one hand and the door base on the other hand. As a result, particularly the fragile holes in the glass of the inner pane are flexibly covered and protected on both sides.

To simplify the construction of the door, the fastening elements secure an intermediate panel. The intermediate panel is provided between the front panel and the inner pane. This additional securing function can be performed particularly securely and in a way which is easy with regard to production and assembly. The fastening elements fasten at least one clamping strip to the door base. The at least one clamping strip secures the intermediate panel to the door base.

The cooking appliance door according to the invention is in particular advantageous for cooking appliances, such as baking ovens.

Other features which are considered as characteristic for the invention are set forth in the appended claims.

Although the invention is illustrated and described herein as embodied in a cooking appliance and in particular a cooking appliance door, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
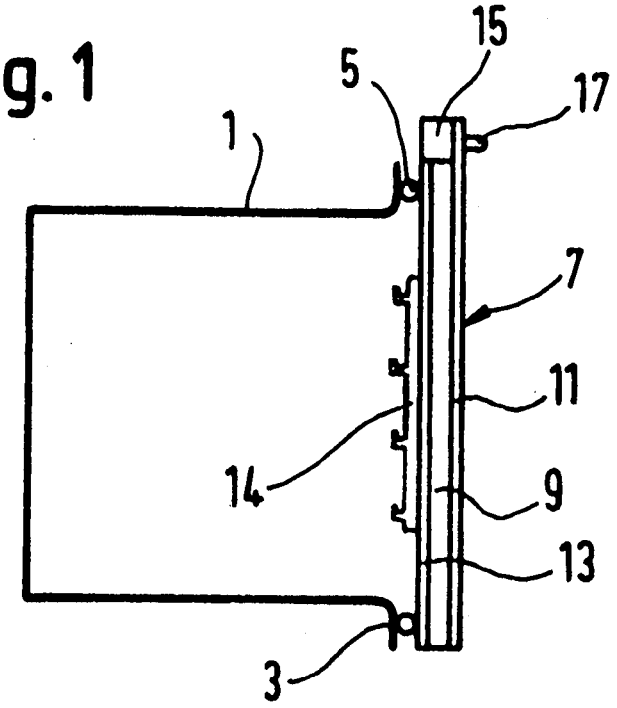
FIG. 1 is a diagrammatically simplified side elevational view of a baking oven with the oven door closed and the oven door having a hook rail.
Figure 2:
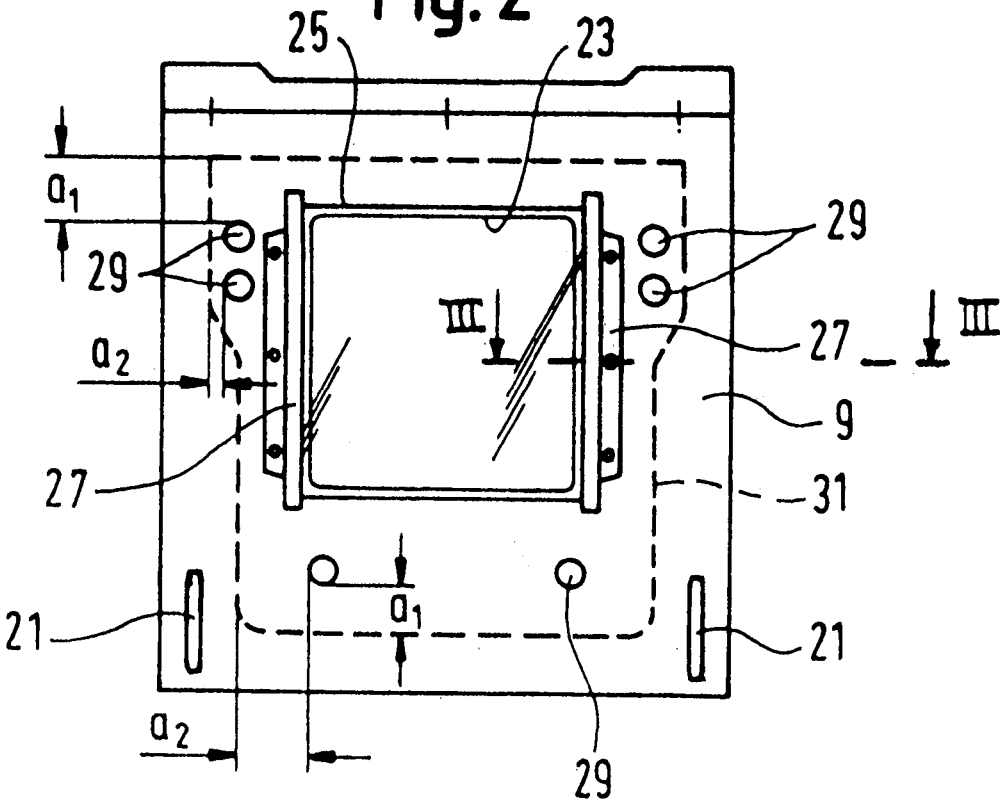
FIG. 2 is a diagrammatic front view of the baking oven door without the front panel and hook rails.
Figure 3:
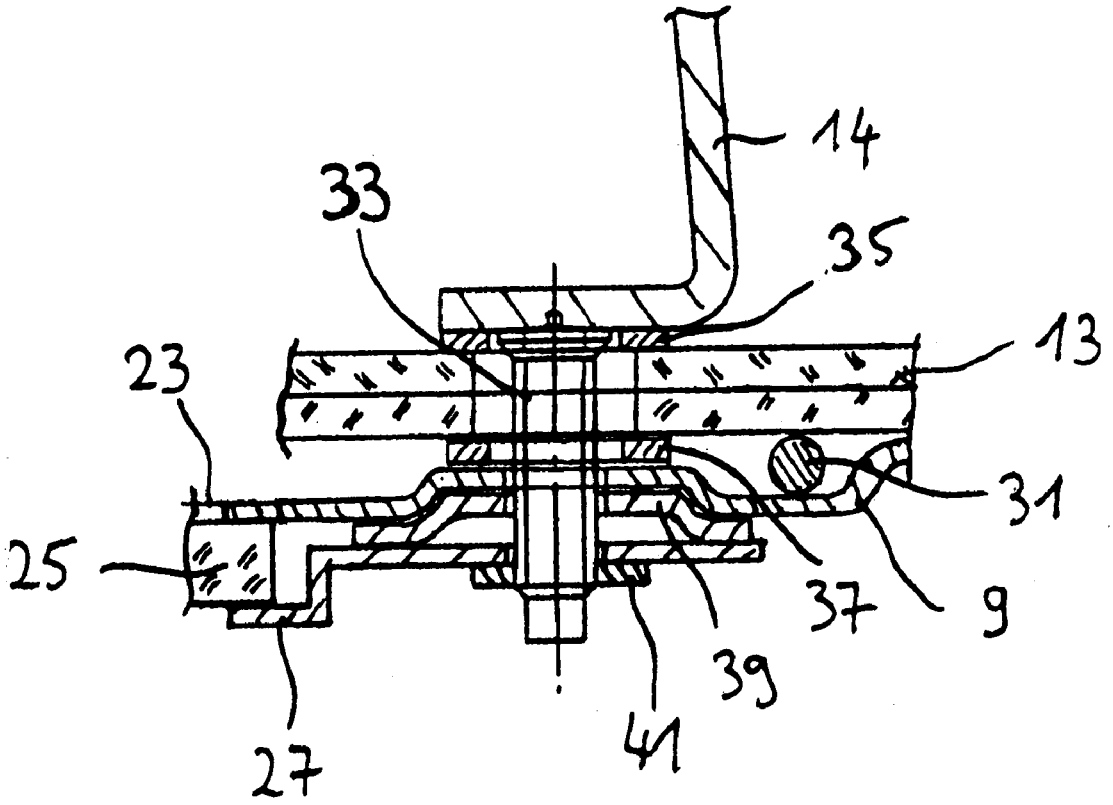
FIG. 3 is an enlarged partial cross-sectional view, essentially along the line III—III in FIG. 2, illustrating the fastening of the hook rail to the door base.

Referring now to the figures of the drawings in detail and first, particularly, to FIG. 1 thereof, there is shown a baking oven having a cuboidal baking oven muffle 1, which is open at the front and has a muffle flange 3 running around its loading opening. A frame-shaped baking oven seal 5, secured to the muffle flange 3, runs around the loading opening. This opening can be closed in an essentially sealed manner through the use of a baking oven door 7 which is configured as an oven carriage with sliding cooking racks and is displaceably guided in a way known per se. The baking oven door 7 has a metallic, stable door frame or base 9, which is shown in FIGS. 1 and 2, and which is completely covered at the front by a glass front panel 11, which is transparent in partial regions. Also secured to the door frame 9, as explained in more detail below, is a inner pane or inner panel 13, which is a double-pane of toughened glass, which may be provided on its inner side, facing the loading opening, with a heat-reflective metal oxide layer. The door frame 9 is similarly covered essentially completely at its rear side by the inner plate or inner pane 13, as is shown in FIG. 1. In this case, the inner pane 13 extends over the entire loading opening of the baking oven muffle 1 and bears in an essentially sealed manner in particular against the frame-shaped baking oven seal 5. Secured to the rear side of the oven door 7, parallel to each other, are two metallic hook rails, known per se, for fixing, hanging or suspending cooking-product supports, such as baking sheets for example, as explained in more detail below with regard to FIG. 3. Fastened to the upper end portion of the door frame 9 is a strip-shaped door grip part 15 of temperature-resistant plastic, extending over the entire width of the baking oven muffle 1 or the baking oven door 7. By suitable openings in the front panel 11, a bow-shaped door grip 17, which is secured at the front, is fastened by screws to the door grip part 15. The baking oven door 7 thus has at the front a completely uninterrupted contour, without any gaps or abutting edges, with the exception of the door grip 17. The rear or inner side of the baking oven door 7 is also configured correspondingly, with only a small abutting edge or a small gap in the region between the inner pane 13 and the rear of the door grip part 15. Except for this small gap, the inner pane 13 is secured invisibly, in other words hidden to a viewer. The inner pane 13 is secured to the door frame 9 without strips or frame elements reaching over the inner side of the inner pane 13.

According to FIG. 2, two fastening profiles 21 are welded to the door frame 9 for receiving and securing sliding runners (not shown) of the oven door 7. Approximately in its central region, the door frame 9 has a viewing window opening 23, in which a viewing window pane 25 is secured. Screwed to the door frame 9 for this purpose are two profiled parts or clamping strips 27 (FIGS. 2, 3), which reach over the edges of the viewing window pane 25 through the use of an angled or bent holding region and pull and hold the pane against the door frame 9. Both the front panel 11 and the inner pane 13 are transparent in the region of the viewing window pane 25. The door frame 9 has screw openings 29 (FIG. 2), which are distributed over various regions of the door frame 9. These screw openings 29 are located within a region bounded by a door inner seal 31 in a frame-shaped manner. The region enclosed by the door inner seal 31 is indicated by a broken line. The door inner seal 31 (see FIG. 3) is secured between the door frame 9 and the inner pane 13 (not visible in FIG. 2).

For spatially bracing or convexly curving the door inner pane 13 in a dish-shaped manner, fastening screws are adhesively bonded (not shown) on the side of the inner pane 13 facing the door frame 9, at the points corresponding to the positions of the screw openings 29 in the door frame 9. During the assembly of the baking oven door 7, the inner pane 13 is fitted with its fastening screws into the corresponding screw openings 29 in the door frame 9. By tightening nuts fitted onto the fastening screws, the inner pane 13 is pulled against the door inner seal 31. On account of the suitably chosen vertical distances $a_1$ and horizontal distances $a_2$ between the fastening points 29 and the respective partial portion of the door inner seal 31, an essentially dish-shaped convex curving of the door inner pane 13 takes place (not shown) as a result of the thickness of the seal 31 and its limited compressibility. A temperature gradient of the inner pane 13, induced by the uneven heating up of the inner pane, increases the extent of the convex curvature in the desired direction on the basis of the defined pre-bracing or convex curving. That is to say that only the distance from the baking oven muffle 1 in the central region of the inner pane 13 is further increased. In its peripheral region, the inner pane 13 bears unchanged against the baking oven seal 5, thereby preventing pressing on the baking oven door 7 or pressing the baking door open.

Three screw bolts 33 are welded to an angled foot portion of the hook rail or cooking-product support brackets 14, one above the other and evenly distributed over the vertical extent of the hook rail 14. The screw bolt 33 protrudes respectively through suitable openings in the inner pane 13 into the door interior, the diameter of these openings being greater than that of the screw bolt 33. Provided between the hook rail 14 and the inner pane 13 is a temperature-resistant and flexible first lining 35. Also provided, between the inner pane 13 and the door frame 9, is a corresponding flexible second lining 37. In this case, the linings 35, 37 may be formed of, for example, Teflon, silicone or sintered graphite. In the region of the opening in the door frame 9 provided for the screw bolts 33, the door frame is embossed, in particular to reduce the distance between the inner pane 13 and the door base 9. Also welded to the door base 9, in the region of the embossing, is a reinforcing plate 39, which is provided with corresponding openings and extends essentially over the entire vertical extent of the hook rail 14. With the profiled part 27 interposed (FIGS. 2, 3), a screw nut 41 is screwed onto the screw bolt 33. As a result, on the one hand the hook rail 14 is flexibly fastened to the door frame 9, on the other hand the inner pane 13 is fastened to the door frame 9 flexibly and in such a manner that it is protected against direct contact with metal parts. Furthermore, the profiled part 27 is fastened to the door frame 9, which clamps the viewing window pane 25 against the door frame 9 in the region of the viewing window opening 23. In this case as well, corresponding sealing elements or flexible spacing elements may be provided.

We claim:

1. A cooking appliance door, comprising:

a door base having a front side and a rear side;

a front panel secured at said front side of said door base;

an inner panel secured at said rear side of said door base and having openings formed therein;

at least one cooking-product support bracket fastened at said rear side of said door base; and fastening elements extending through said openings formed in said inner panel for fastening said at least one cooking-product support bracket to said door base.

2. The cooking appliance door according to claim 1, wherein said door base has a reinforcing plate, and said at least one cooking-product support bracket is fastened to said door base and to said reinforcing plate.

3. The cooking appliance door according to claim 1, including:

a flexible spacing element held between said at least one cooking-product support bracket and said inner panel; and a further flexible spacing element held between said inner panel and said door base.

4. The cooking appliance door according to claim 1, including an intermediate panel disposed between said front panel and said inner panel, said intermediate panel being secured to said door base with said fastening elements.

5. The cooking appliance door according to claim 4, including at least one clamping strip fastened to said door base with said fastening elements, said at least one clamping strip securing said intermediate panel to said door base.

6. A cooking appliance, comprising:

an oven muffle with a loading opening formed therein;

a cooking appliance door connected to said oven muffle for closing said loading opening, said cooking appliance door including:

a door base having a front side and a rear side;

a front panel secured at said front side of said door base;

an inner panel secured at said rear side of said door base and having openings formed therein;

at least one cooking-product support bracket fastened at said rear side of said door base; and fastening elements extending through said openings formed in said inner panel for fastening said at least one cooking-product support bracket to said door base.

7. A baking oven, comprising:

a baking oven muffle with a loading opening formed therein;

a baking oven door connected to said baking oven muffle for closing said loading opening, said baking oven door including:

a door base having a front side and a rear side;

a front panel secured at said front side of said door base;

an inner panel secured at said rear side of said door base and having openings formed therein;

at least one cooking-product support bracket fastened at said rear side of said door base; and fastening elements extending through said openings formed in said inner panel for fastening said at least one cooking-product support bracket to said door base.

* * * * *